US011509120B2

(12) United States Patent
Woo

(10) Patent No.: US 11,509,120 B2
(45) Date of Patent: Nov. 22, 2022

(54) DUAL SPARK PLUG

(71) Applicants: HYUNDAI MOTOR COMPANY, Seoul (KR); KIA MOTORS CORPORATION, Seoul (KR)

(72) Inventor: Soo Hyung Woo, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 44 days.

(21) Appl. No.: 17/109,437

(22) Filed: Dec. 2, 2020

(65) Prior Publication Data

US 2021/0399531 A1 Dec. 23, 2021

(30) Foreign Application Priority Data

Jun. 17, 2020 (KR) ..... 10-2020-0073458

(51) Int. Cl.
*H01T 13/22* (2006.01)
*H01T 13/46* (2006.01)
*H01T 13/41* (2006.01)

(52) U.S. Cl.
CPC ..... *H01T 13/46* (2013.01); *H01T 13/22* (2013.01); *H01T 13/41* (2013.01)

(58) Field of Classification Search
CPC ..... H01T 13/22
USPC ..... 313/118–145
See application file for complete search history.

(56) References Cited

U.S. PATENT DOCUMENTS 3,350,352 A * 10/1967 Smith ..... C08G 59/30 549/559
4,004,562 A * 1/1977 Rado ..... H01T 13/462 313/142
11,251,588 B1 * 2/2022 Woo ..... H01T 13/38
2004/0195949 A1 * 10/2004 Hiramatsu ..... H01T 13/467 313/135
2006/0267469 A1 11/2006 Alger, II et al.
2014/0076295 A1 * 3/2014 Zheng ..... H01T 13/467 123/621
2017/0254312 A1 * 9/2017 Zheng ..... F02P 15/001
2018/0142664 A1 * 5/2018 Assaad ..... H01T 13/22
2020/0235552 A1 * 7/2020 Fuchs ..... H01T 13/46

FOREIGN PATENT DOCUMENTS

DE 10329269 B4 * 12/2005 ..... F02P 15/08

* cited by examiner

*Primary Examiner* — Christopher M Raabe
(74) *Attorney, Agent, or Firm* — Lempia Summerfield Katz LLC

(57) ABSTRACT

A dual spark plug may include: a metal body made of metal material, an insulating body provided inside of the metal body and made of an insulating material, a pair of central electrodes provided inside of the insulating body and electrically connected with an ignition coil, and a pair of ground electrodes respectively extended from both ends the metal body, and spaced apart from ends of the pair of central electrodes by a predetermined distance.

5 Claims, 6 Drawing Sheets

DUAL SPARK PLUG

CROSS-REFERENCE TO RELATED APPLICATION

This application claims priority to and the benefit of Korean Patent Application No. 10-2020-0073458, filed on Jun. 17, 2020, the entire contents of which are incorporated herein by reference.

FIELD

The present disclosure relates to a dual spark plug. More particularly, the present disclosure relates to a dual spark plug that can efficiently ignite air and fuel mixture in an engine.

BACKGROUND

The statements in this section merely provide background information related to the present disclosure and may not constitute prior art.

In gasoline vehicles, a mixture of air and fuel is ignited by a spark generated by a spark plug, and combustion is performed. In other words, the mixture injected into a combustion chamber during a compression stroke is ignited by the discharge phenomenon of the spark plug, and energy required for the vehicle's driving is generated while going through an expansion stroke of high temperature and high pressure.

The spark plug provided in the gasoline vehicle plays a role of igniting the compressed mixture by spark discharge due to high voltage current generated from an ignition coil.

In the case of a general gasoline engine, it is mainly operated to combust with a theoretical air/fuel ratio (14.7:1, $\lambda=1$).

However, in the case of an engine to implement lean burn combustion, the air/fuel ratio is approximately 30:1 ($\lambda=2$). In this case, the mixture in the combustion chamber has very little injected fuel compared to the amount of air, so even if spark discharge occurs by the spark plug, the mixture does not ignite (e.g., misfire), or an incomplete combustion occurs.

Therefore, it has been required research and development on spark plugs to implement lean combustion.

The above information disclosed in this Background section is only for enhancement of understanding of the background of the present disclosure, and therefore it may contain information that does not form the prior art that is already known to a person of ordinary skill in the art.

SUMMARY

The present disclosure provides a dual spark plug for efficiently combusting lean air-fuel mixture supplied in a combustion chamber.

A dual spark plug according to an exemplary form of the present disclosure may include a metal body made of metal material, an insulating body provided inside of the metal body and made of an insulating material, a pair of central electrodes provided inside of the insulating body and electrically connected with an ignition coil, and a pair of ground electrodes respectively extended from both ends the metal body, and spaced apart from ends of the pair of central electrodes by a predetermined distance.

The pair of central electrodes respectively may include: a terminal portion electrically connected with the ignition coil, a noise filter portion extended from the terminal portion; and an electrode portion extended from the noise filter portion and spaced apart from the pair of ground electrodes by a predetermined interval.

The pair of central electrodes may include a first central electrode and a second central electrode, the terminal portion of the first central electrode extends above the center of the insulating body, the terminal portion of the second central electrode extends to the upper side of the insulating body, and the terminal portions of the first central electrode and the second central electrode are electrically connected with the ignition coil, respectively.

A threaded portion may be formed on an outer lower portion of the metal body.

The pair of ground electrodes may be formed by respectively bending toward ends of the electrode portions of the pair of central electrodes.

The noise filter portion may be made of a glass material.

The insulating body may be made of ceramic material.

According to an exemplary form of the present disclosure, a pair of central electrodes and a pair of ground electrodes are provided in a metal body, thereby improving combustion efficiency of lean mixture by increasing the Ignition energy.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
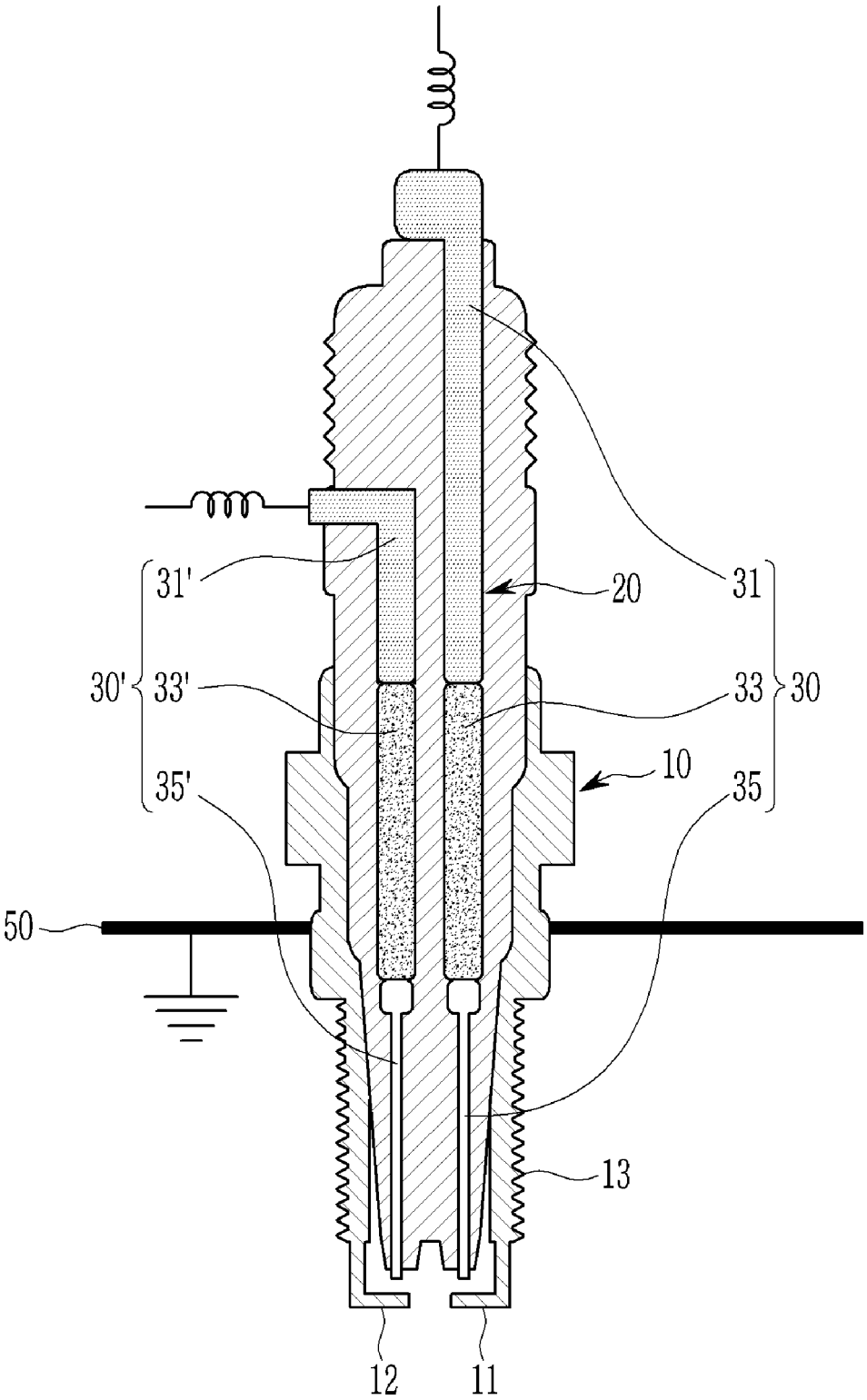
FIG. 1 is a cross-sectional view of a dual spark plug according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure will be described more fully hereinafter with reference to the accompanying drawings, in which exemplary forms of the present disclosure are shown. As those skilled in the art would realize, the described forms may be modified in various different ways, all without departing from the spirit or scope of the present disclosure.

Also, the size and thickness of each element are arbitrarily shown in the drawings, but the present disclosure is not necessarily limited thereto, and in the drawings, the thickness of layers, films, panels, regions, etc., are exaggerated for clarity.

Hereinafter, a dual spark plug according to an exemplary form of the present disclosure will be described in detail with reference to accompanying drawings.

Figure 2:
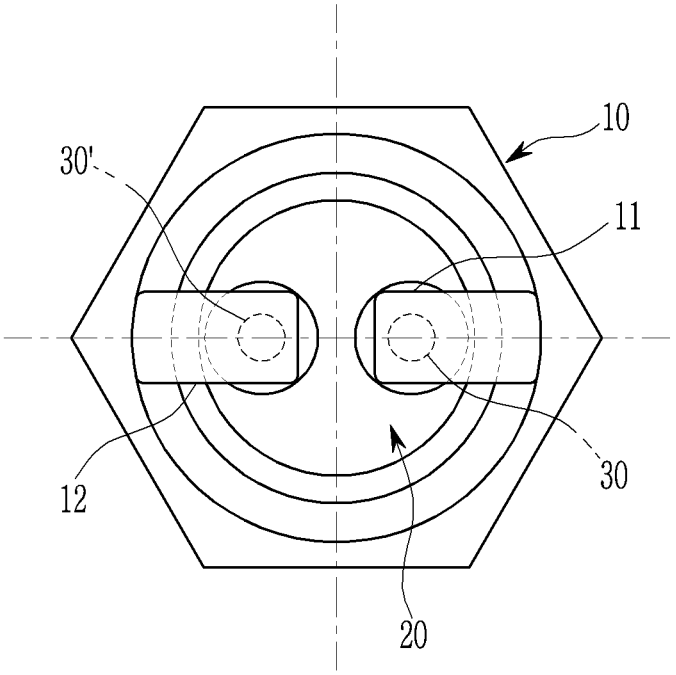
FIG. 2 is a plane view of a dual spark plug according to an exemplary form of the present disclosure.

FIG. 1 is a cross-sectional view of a dual spark plug according to an exemplary form of the present disclosure. FIG. 2 is a plane view of a dual spark plug according to an exemplary form of the present disclosure.

As shown in FIG. 1 and FIG. 2, a dual spark plug according to an exemplary form of the present disclosure includes: a metal body 10 made of a metal material, an insulating body 20 provided in the metal body 10 and made of an insulating material, a pair of central electrodes 30 and 30' provided in the insulating body 20, and a pair of ground electrodes 11, and 12 respectively extended from the metal body 10 and generating a spark discharge between the central electrode 30 and 30'.

The metal body 10 is a part that is mounted on the cylinder 50 of an engine and is formed in a substantially cylinder shape. And a threaded portion 13 is formed on a lower outside of the metal body 10 for coupling with the cylinder 50. A thread is formed on the cylinder 50 of the engine corresponding to the threaded portion 13 of the metal body 10. Accordingly, the dual spark plug and the cylinder 50 of the engine are screw-engaged with each other. Since the metal body 10 and the cylinder 50 of the engine are screw-engaged with each other, the metal body 10 and the ground electrode 11 and 12 are formed a ground terminal (or, negative electrode).

The insulating body 20 may be made of a ceramic material, and provided in the metal body 10. The insulating body 20 may prevent the pair of central electrodes from being short-circuited.

A pair of central electrodes 30 and 30' are provide inside the insulating body 20, and may be disposed apart from each other by a predetermined distance.

A pair of central electrodes 30 and 30' includes a first central electrode 30 and a second central electrode 30', and the first central electrode 30 includes a terminal portion 31, a noise filter portion 33, and an electrode portion 35, and the second central electrode 30' includes a terminal portion 31', noise filter portion 33', and an electrode portion 35'.

The terminal portion 31 and 31' of the central electrode 30 and 30' may be electrically connected with an ignition coil. At this time, the terminal portion 31 of the first central electrode 30 may be extended to an upper center of the insulating body 20 and electrically connected with the ignition coil. And the terminal portion 31' of the second central electrode 30' may be extended to an upper side of the insulating body 20 and electrically connected with the ignition coil.

As such, since the terminal portion 31 of the central electrode 30 is electrically connected with the ignition coil by extending to the upper center of the insulating body 20 and the terminal portion 31' of the second central electrode 30' is electrically connected with the ignition coil by extending to the upper side of the insulating body 20, it is possible to minimize electrical interference or noise between the terminal portions 31 and 31' of the central electrodes 30 and 30' when high voltage (or, high current) is supplied to the terminal portions 31 and 31' of each central electrodes 30 and 30' from the ignition coil.

The noise filter portion 33 and 33' of the central electrode 30 and 30' is a part for removing noise generated when high voltage (or, high current) is supplied to the terminal portions 31 and 31' of each central electrode 30 and 30' from the ignition coil. The noise filter portion 33 and 33' may be formed by surrounding the center portion of the central electrode 30 and 303. The noise filter portions 33 and 33' may be made of glass material.

Spark discharge is generated between the electrode portion 35 and 35' of the central electrode 30 and 30' and the ground electrode 11 and 12. The central electrode 30 and 30' may be extended under the insulating body 20.

A pair of ground electrodes 11 and 12 may include a first ground electrode 11 and 12 and a second ground electrode 11 and 12, and may be bended in a direction facing each other at a lower portion of the metal body 10. An end of the pair of ground electrodes 11, and 12 may be spaced apart from an end of the electrode portion 35 and 35' by a predetermined distance. Accordingly, when high current supplied to the central electrode 30 and 30' from the ignition coil, mixed air inflow into the cylinder 50 of the engine is ignited by an electric discharge generated between the electrode portion 35 and 35' and the ground electrode 11 and 12.

Herein, an operation and an effect of a dual spark plug according to an exemplary form of the present disclosure will be described in detail.

Figure 3:
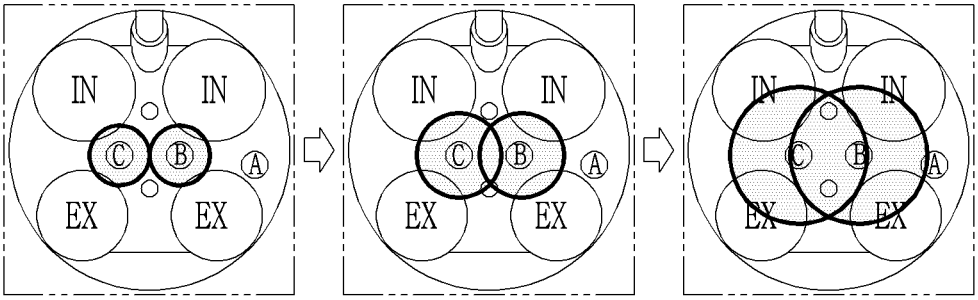
FIG. 3 is a drawing for explaining an operation of a dual spark plug according to an exemplary form of the present disclosure.

FIG. 3 is a drawing for explaining an operation of a dual spark plug according to an exemplary form of the present disclosure.

Referring to FIG. 3, the dual spark plug may be mounted in a central portion of the cylinder 50 of the engine. When high current applied to the central electrode 30 and 30' from the ignition coil, the electric discharge is generated between the central electrode 30 and 30' and the electrode portion 35 and 35', thereby igniting the mixed air.

A size of flame generated between the pair of central electrodes 30 and 30' and the pair of ground electrodes 11 and 12 is small at the beginning of combustion, but the size of flame become gradually bigger and the mixed air in the cylinder is combusted as the flame gradually propagates over time.

At this time, since flames are generated between the pair of the central electrodes 30 and 30' and the pair of the ground electrodes 11 and 12 and the flames are propagates inside the combustion chamber, a propagation speed of the flame is faster than conventional spark plug including one central electrode and one ground electrode.

Figure 4:
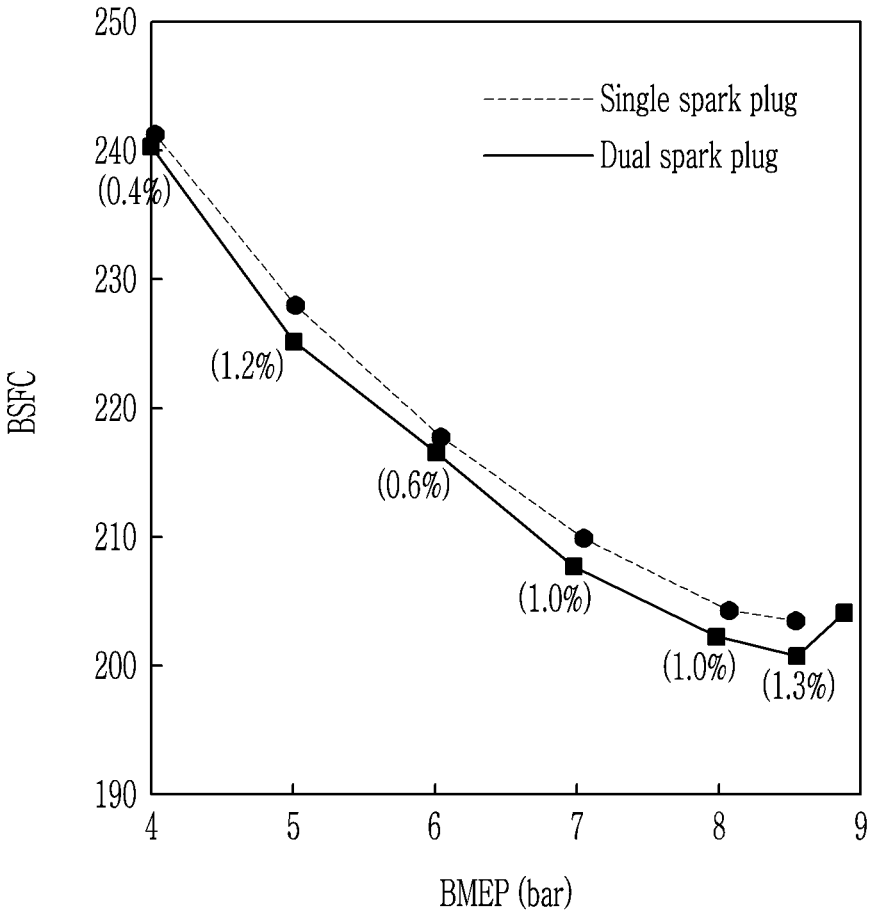
FIG. 4 is a graph for explaining fuel efficiency of a dual spark plug according to an exemplary form of the present disclosure.

FIG. 4 is a graph for explaining fuel efficiency of a dual spark plug according to an exemplary form of the present disclosure. FIG. 4 shows a BSFC (Brake Specific Fuel Consumption) according to a BMEP (brake mean effective pressure).

As shown in FIG. 4, compared to the case of using a single spark plug, when using the dual spark plug according to the present disclosure, it can be seen that about 0.4-1.3% of BSFC is improved.

Figure 5:
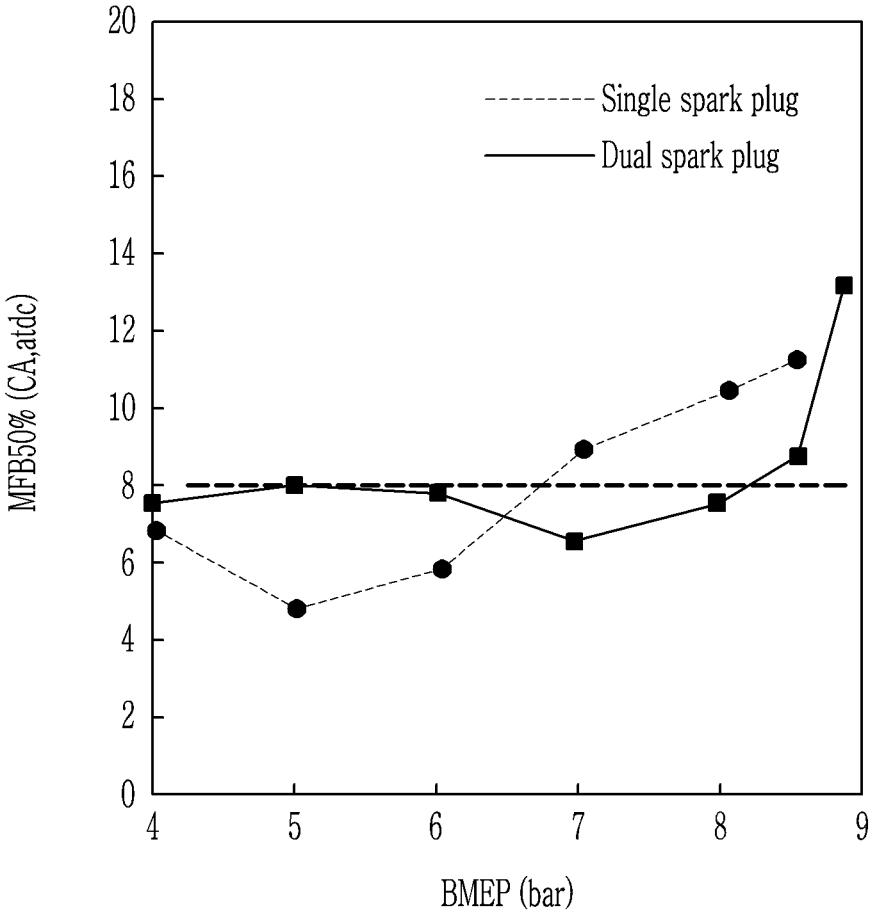
FIG. 5 is a graph for explaining knocking characteristic of a dual spark plug according to an exemplary form of the present disclosure.

FIG. 5 is a graph for explaining knocking characteristic of a dual spark plug according to an exemplary form of the present disclosure. FIG. 5 shows MFB 50% (50% mass fraction burned) according to BMEP (brake mean effective pressure).

As shown in FIG. 5, it can be seen that a MFB appears near a MBT (maximum brake torque) timing in most BMEP regions when the dual spark plug are used. Therefore, the usage of the dual spark plug significantly reduces the possibility of occurrence of knocking as compared to using a single spark.

Figure 6:
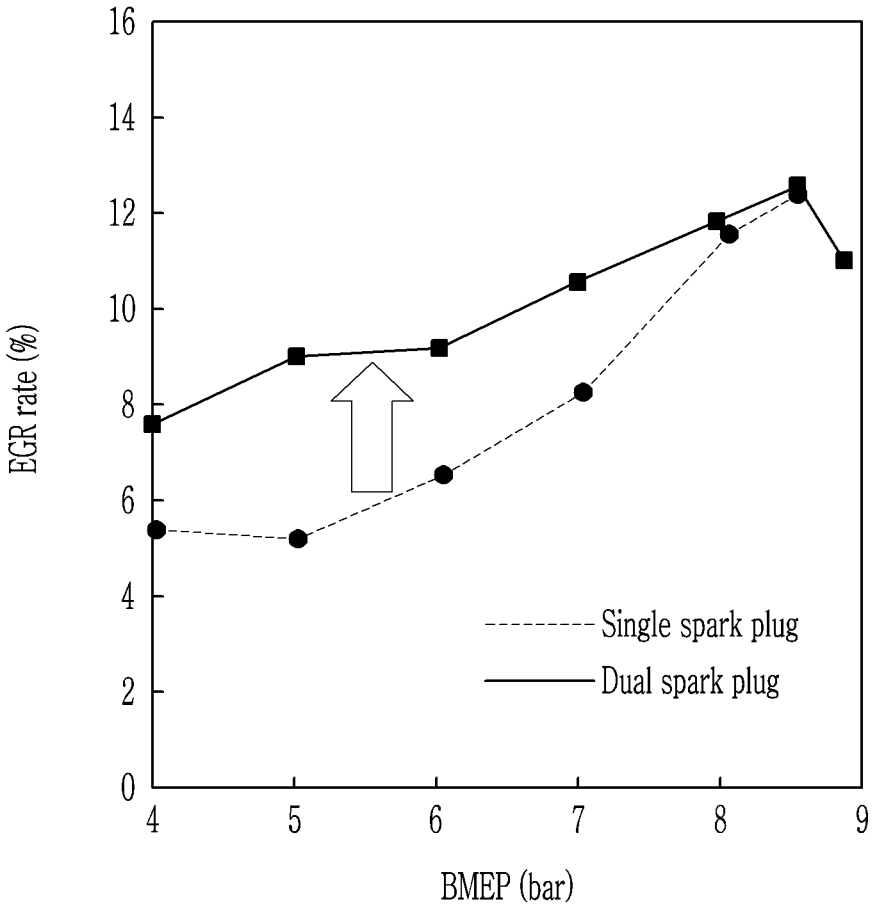
FIG. 6 is a graph for explaining an EGR ratio of a dual spark plug according to an exemplary form of the present disclosure.

FIG. 6 is a graph for explaining an EGR ratio of a dual spark plug according to an exemplary form of the present disclosure. FIG. 6 shows the exhaust gas recirculation ratio (EGR) according to a brake mean effective pressure (BMEP).

As shown in FIG. 6, it can be seen that the EGR ratio increases in all regions of the BMEP when using the dual spark plug compared to the case of using the single spark plug.

As described above, according to an exemplary form of the present disclosure, since the pair of central electrodes 30 and 30' is disposed in the insulating body 20, and the pair of ground electrodes 11, and 12 corresponding to the pair of central electrodes 30 and 30' is provided, it is possible to improve combustion efficiency of lean mixture by increasing the Ignition energy.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

DESCRIPTION OF SYMBOLS

10: metal body
11, 12: ground electrode
13: threaded portion
20: insulating body
30, 30': central electrode
31, 31': terminal portion
33, 33': noise filter portion
35, 35': electrode portion
50: cylinder

What is claimed is:

1. A dual spark plug comprising:
a metal body made of metal material;
an insulating body provided inside of the metal body and made of an insulating material;
a pair of central electrodes provided inside of the insulating body and electrically connected with an ignition coil; and
a pair of ground electrodes respectively extended from both ends of the metal body, and spaced apart from ends of the pair of central electrodes by a predetermined distance,
wherein the pair of central electrodes respectively includes:
a terminal portion electrically connected with the ignition coil;
a noise filter portion extended from the terminal portion; and
an electrode portion extended from the noise filter portion and spaced apart from the pair of ground electrodes by a predetermined interval, and
wherein:
the pair of central electrodes includes a first central electrode and a second central electrode,
the terminal portion of the first central electrode extends above a center of the insulating body,
the terminal portion of the second central electrode extends to an upper side and is bent toward a side of the insulating body, and
the terminal portions of the first central electrode and the second central electrode are electrically connected with the ignition coil, respectively.

2. The dual spark plug of claim 1, wherein:
the pair of ground electrodes is formed by respectively bending toward ends of the electrode portions of the pair of central electrodes.

3. The dual spark plug of claim 1, wherein:
the noise filter portion is made of a glass material.

4. The dual spark plug of claim 1, wherein:
a threaded portion is formed on an outer lower portion of the metal body.

5. The dual spark plug of claim 1, wherein:
the insulating body is made of ceramic material.

* * * * *